US009930947B2

(12) United States Patent
Liguori et al.

(10) Patent No.: US 9,930,947 B2
(45) Date of Patent: Apr. 3, 2018

(54) PAYMENT CARD ENCLOSURE SYSTEM AND METHODS OF MANUFACTURING AND USE

(71) Applicant: Hot Concepts, LLC, San Diego, CA (US)

(72) Inventors: Thomas Alfred Liguori, San Diego, CA (US); Billy Ray Fox, Shelbyville, TN (US); Jason Allen Cunningham, Springdale, AR (US)

( * ) Notice: Subject to any disclaimer, the term of this patent is extended or adjusted under 35 U.S.C. 154(b) by 0 days.

(21) Appl. No.: 15/268,931

(22) Filed: Sep. 19, 2016

(65) Prior Publication Data

US 2017/0127779 A1 May 11, 2017

Related U.S. Application Data

(60) Provisional application No. 62/221,009, filed on Sep. 19, 2015.

(51) Int. Cl.

| | |
|---|---|
| ***B65D 85/48*** | (2006.01) |
| ***A45C 11/18*** | (2006.01) |
| ***B65D 73/00*** | (2006.01) |
| ***B42D 15/04*** | (2006.01) |

(52) U.S. Cl.

CPC ..... *A45C 11/182* (2013.01); *B42D 15/045* (2013.01); *B65D 73/0028* (2013.01); *B65D 73/0078* (2013.01)

(58) Field of Classification Search

CPC ..... A45C 11/182; A45C 2011/186; B65D 73/0078

USPC ..... 206/37, 449, 460; 229/68.1, 71, 72, 76; 235/380, 486

See application file for complete search history.

(56) References Cited

U.S. PATENT DOCUMENTS

| | | | | |
|---|---|---|---|---|
| 1,896,573 | A * | 2/1933 | Buxton | B42F 13/02 206/37 |
| 3,184,046 | A * | 5/1965 | Berg | B65D 5/4208 206/780 |
| 4,577,757 | A * | 3/1986 | Hustad | B65D 75/322 206/461 |
| 5,203,457 | A * | 4/1993 | Garcia | B65D 75/14 206/449 |
| 8,915,366 | B2 * | 12/2014 | Smith | B65D 73/0078 206/449 |
| 2001/0040115 | A1 * | 11/2001 | Wani | B65D 75/36 206/705 |
| 2005/0279825 | A1 * | 12/2005 | Ashby | B65D 27/14 235/380 |
| 2014/0116908 | A1 * | 5/2014 | Beyer | B65D 1/00 206/449 |

* cited by examiner

*Primary Examiner* — Luan K Bui
(74) *Attorney, Agent, or Firm* — Todd J. Langford; Greenspoon Marder LLP

(57) ABSTRACT

A three sectioned payment card enclosure includes a flap that is partially cut out from one of the sections. The flap includes an attachment portion with an adhesive for securing payment cards thereto. The flap is displaced from the surrounding section of the payment card enclosure such that when the recipient opens the card, the payment card resides above and away from the surface of the surrounding section.

14 Claims, 7 Drawing Sheets

PAYMENT CARD ENCLOSURE SYSTEM AND METHODS OF MANUFACTURING AND USE

CROSS-REFERENCE TO RELATED APPLICATIONS

This application claims the benefit of U.S. Prov. Pat. App. No. 62/221,009 filed on Sep. 19, 2015, the entirety of which is hereby incorporated by reference.

BACKGROUND OF THE INVENTION

Field of the Invention

This invention relates to the general field of packaging, and more specifically toward a payment card enclosure system and methods of manufacturing and use. A three sectioned payment card enclosure includes a flap that is partially cut out from one of the sections. The flap includes an attachment portion with an adhesive for securing payment cards thereto. The flap is displaced from the surrounding section of the payment card enclosure such that when the recipient opens the card, the payment card resides above and away from the surface of the surrounding section.

Many find that it is difficult to give the right gift to their loved ones. Instead of spending countless hours finding a gift that the recipient may already have or not even like, people turn to gift cards or other pre-paid cards. These gifts are considered by some to be more personalized than simply giving cash, while still providing freedom to the recipient to purchase an item they truly want.

Certain cultural norms dictate that presents be wrapped or otherwise hidden from view from the recipient until they are delivered and opened. Packages are wrapped using gift-wrap or placed into a bag with tissue paper. Unfortunately, gift cards are so small that they are not easily wrapped, and likewise would be humorously small within many if not most gift bags. At the same time, it is considered by some to be impolite to just hand over a gift card to the recipient.

Thus there has existed a long-felt need for a specialized enclosure for payment cards, such as gift cards and pre-paid debit/credit cards, that provide an appropriate packaging for a gift from one to another.

SUMMARY OF THE INVENTION

The current invention provides a solution by having a three sectioned payment card enclosure that includes a flap that is partially cut out from one of the sections. The flap includes an attachment portion with an adhesive for securing payment cards thereto. The flap is displaced from the surrounding section of the payment card enclosure such that when the recipient opens the card, the payment card resides above and away from the surface of the surrounding section.

It is an object of the current disclosure to provide a payment card enclosure for delivering gift cards.

It is another object of the current disclosure to provide a method for manufacturing a payment card enclosure.

It is a further object of this disclosure to provide a method for using a payment card enclosure.

It is an additional object of the current disclosure to provide an enclosure for distributing a single payment card.

It is yet another object of the current disclosure to provide an enclosure for distributing multiple payment cards.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases may be absent. Additionally, the various embodiments set forth herein are described in terms of exemplary block diagrams, flow charts and other illustrations. As will become apparent to one of ordinary skill in the art after reading this document, the illustrated embodiments and their various alternatives can be implemented without confinement to the illustrated examples. For example, diagrams and their accompanying description should not be construed as mandating a particular architecture or configuration.

As used herein, payment cards include gift cards, pre-paid cards, debit cards, credit cards, and other similar sized and shaped items.

Embodiments of the current disclosure include a payment card enclosure comprising a first section, a second section, and a third section, where the first section is secured to the second section, and where the second section is secured to the third section, where the third section comprises an extension flap and an attachment flap, where the extension flap and attachment flap are cut from the third section, where the extension flap is secured to the third section along a fold line, and where the attachment flap is secured to the extension flap. The first section is secured to the second section along a fold line, and wherein the second section is secured to the third section along a fold line. The adhesive is between the second section and third section, where the adhesive permanently affixes the second section to the third section. There is no adhesive in between a middle portion of the second section and a middle portion of the third section. The attachment flap comprises a removal tab. The attachment flap comprises an adhesive. The payment card is secured to the attachment flap by the adhesive. The extension flap is angled toward the first section, or alternatively, the extension flap is angled towards a side of the third section that is not secured to the second section. The third section further comprises a second extension flap and a second attachment flap, where the second extension flap and second attachment flap are cut from the third section, where the second extension flap is secured to the third section along a fold line, and where the second attachment flap is secured to the second extension flap.

Other embodiments of the current disclosure include a payment card enclosure comprising a first section, a second section, a third section, and a permanent adhesive, where the first section is secured to the second section along a fold line, and where the second section is secured to the third section along a fold line, where the permanent adhesive is between the second section and third section, where the permanent adhesive permanently affixes the second section to the third section, where the third section comprises an extension flap and an attachment flap, where the extension flap and attachment flap are cut from the third section, where the extension flap is secured to the third section along a fold line, and where the attachment flap is secured to the extension flap, where the attachment flap comprises an adhesive. There is no permanent adhesive in between a middle portion of the second section and a middle portion of the third section. The extension flap is angled toward the first section, or alternatively, the extension flap is angled towards a side of the third section that is not secured to the second section. The third section further comprises a second extension flap and a second attachment flap, where the second extension flap and second attachment flap are cut from the third section, where the second extension flap is secured to the third section along a fold line, and where the second attachment flap is secured to the second extension flap.

Further embodiments of the current disclosure provide for a method of constructing a payment card enclosure comprising the steps of cutting a flap section from a third section of a sheet of material; adding a fold line to the flap section thereby forming an extension flap and an attachment flap; applying an adhesive to the attachment flap; applying a permanent adhesive to a second section of the sheet of material, to the third section of the sheet of material, or both the second section of the sheet of material and the third section of the sheet of material; after applying the permanent adhesive, folding the third section and the second section together such that the adhesive on the attachment flap does not face the second section; and adding a fold line between a first section of the sheet of material and the second section of the sheet of material. The first section, second section, and third section of the sheet of material are the same size and shape. The step of adding a fold line between the first section and second section of the sheet of material is done by folding the first section over the second section and third section of the sheet of material. The method further comprises the step of placing a strap of material over the adhesive on the attachment flap. The sheet of material is rectangular.

There has thus been outlined, rather broadly, the more important features of the invention in order that the detailed description thereof may be better understood, and in order that the present contribution to the art may be better appreciated. There are additional features of the invention that will be described hereinafter and which will form the subject matter of the claims appended hereto. The features listed herein and other features, aspects and advantages of the present invention will become better understood with reference to the following description and appended claims.

BRIEF DESCRIPTION OF THE FIGURES

The accompanying drawings, which are incorporated in and form a part of this specification, illustrate embodiments of the invention and together with the description, serve to explain the principles of this invention.

DETAILED DESCRIPTION OF THE INVENTION

Figure 1:
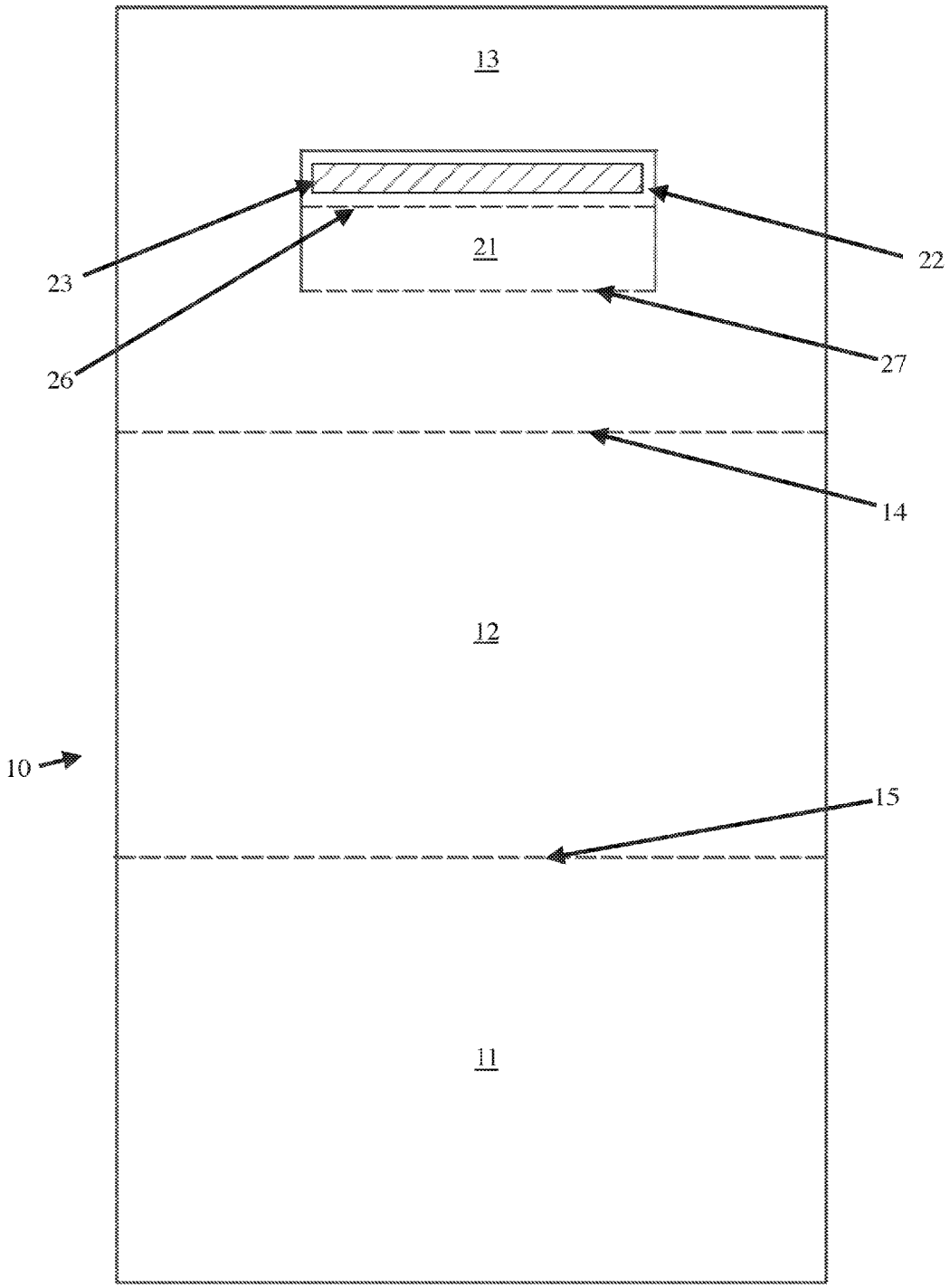
FIG. 1 is a back view of an unassembled payment card enclosure according to selected embodiments of the current disclosure.

Many aspects of the invention can be better understood with the references made to the drawings below. The components in the drawings are not necessarily drawn to scale. Instead, emphasis is placed upon clearly illustrating the components of the present invention. Moreover, like reference numerals designate corresponding parts through the several views in the drawings.

FIG. 1 is a back view of an unassembled payment card enclosure according to selected embodiments of the current disclosure. The payment card enclosure includes a first section 11, second section 12, and third section 13. The third section includes an extension flap 21 and an attachment flap 22. The extension flap 21 and attachment flap 22 are cutout from the third section 13, except along fold line 27, which secures the extension flap 21 to the third section 13. The attachment flap 22 is secured to the extension flap 21 along fold line 26. A strip of adhesive 23 resides on attachment flap 22. The payment card enclosure may be folded along fold lines 14 and 15, discussed in more detail below.

Figure 2:
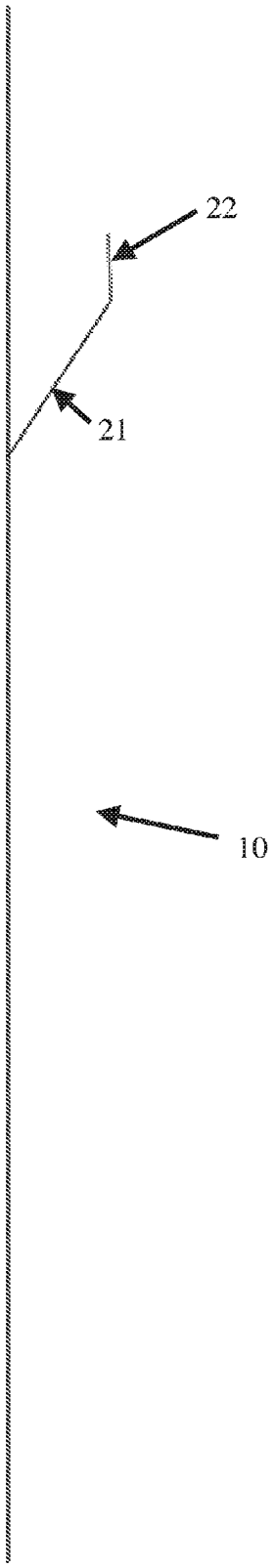
FIG. 2 is a side view of an unassembled payment card enclosure according to selected embodiments of the current disclosure.

FIG. 2 is a side view of an unassembled payment card enclosure according to selected embodiments of the current disclosure. The extension flap 21, being only secured to the third section along a fold line, may angle away from the third section of the payment card enclosure 10. This displaces the attachment flap 22 from the third section.

Figure 3:
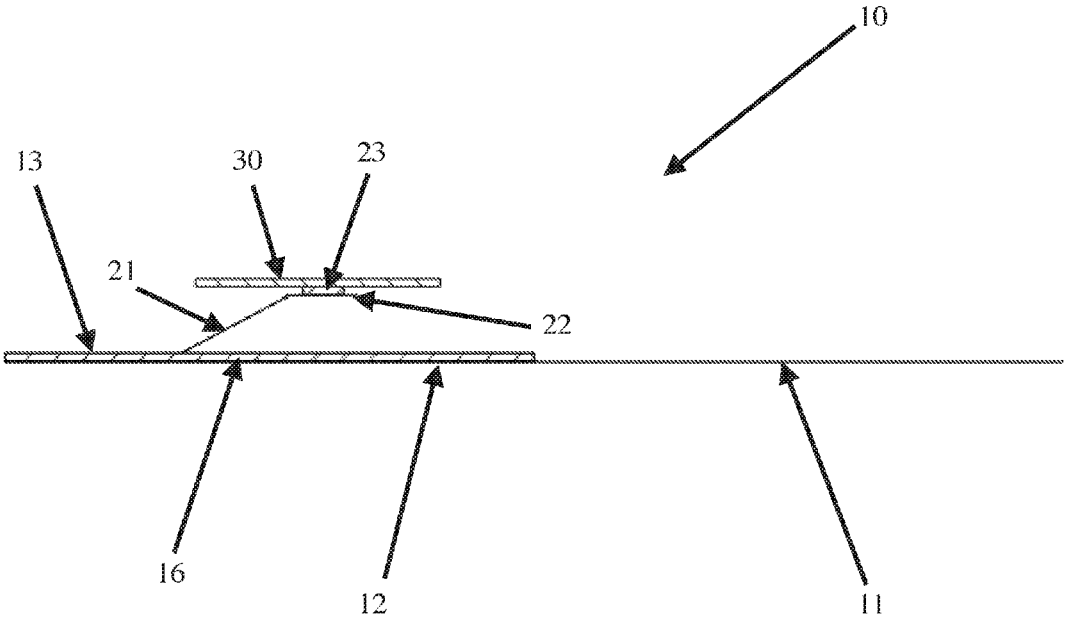
FIG. 3 is a side view of an assembled payment card enclosure according to selected embodiments of the current disclosure.

FIG. 3 is a side view of an assembled payment card enclosure according to selected embodiments of the current disclosure. To assemble the card, the third section 13 is folder over the second section 12. An adhesive 16 is applied between the third section 13 and second section 12 to permanently affix the two sections together. The first section 11, second section 12, and third section 13 each have the same height and width, such when folder over each other, they have the same dimensions. In a particular embodiment, the adhesive 16 is only used toward the outer edges of each section, and the middle or inner portion is left without adhesive such that the extension flap 21 and attachment flap 22 may move freely away from the third section 13 and second section 12. An adhesive 23 secures a payment card 30 to the attachment flap 22, and thus to the payment card enclosure 10.

Figure 4:
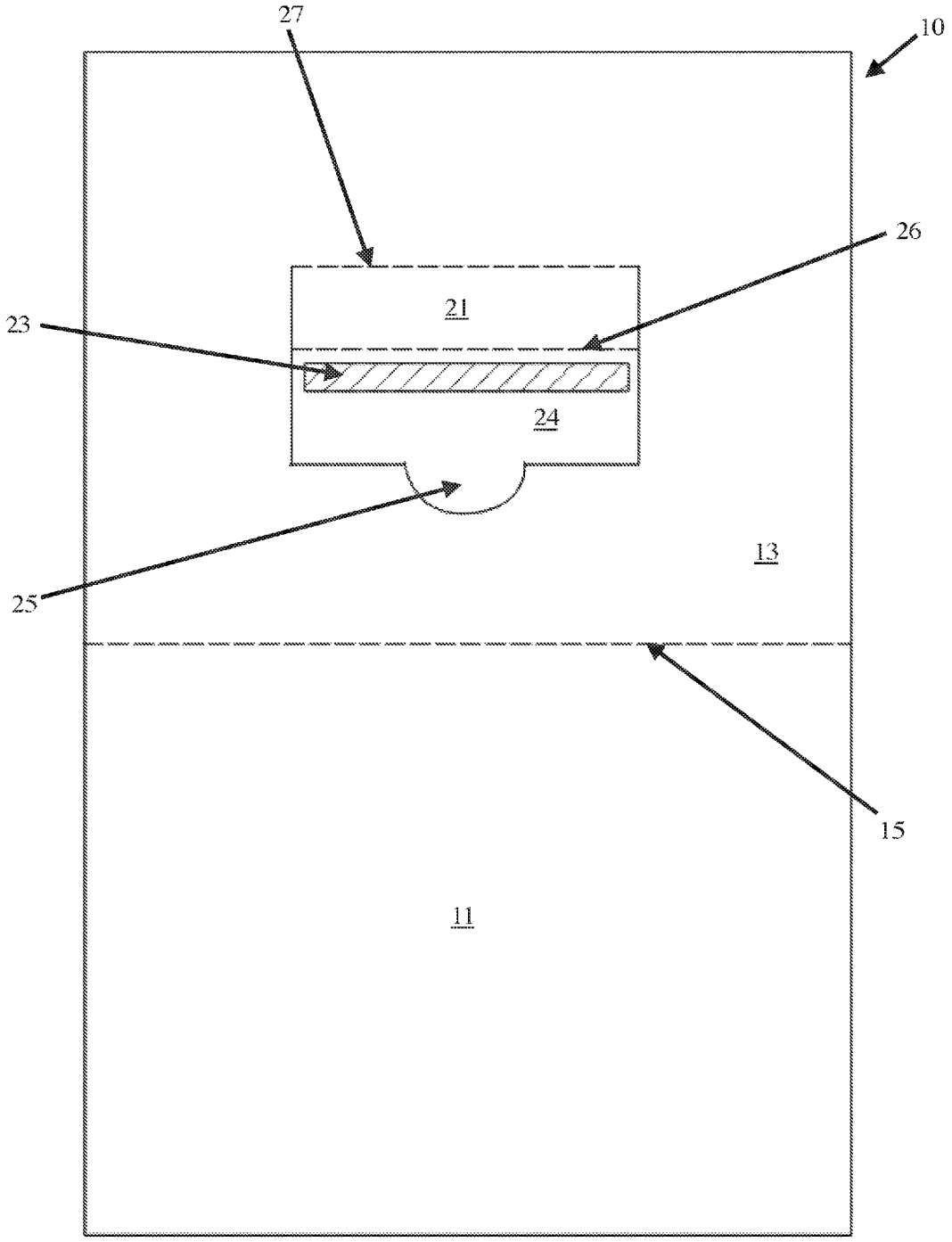
FIG. 4 is a front view of a payment card enclosure according to selected embodiments of the current disclosure.

FIG. 4 is a front view of a payment card enclosure according to selected embodiments of the current disclosure. The payment card enclosure 10 includes an extension flap 21 secured to the third section 13 along fold line 27. The extension flap 21 is secured to the attachment flap 24 along fold line 26. A strip of adhesive 23 is affixed to the attachment flap 24 to secure a payment card (not shown in this figure) thereto. The attachment flap 24 includes a removal tab 25. The removal tab 25 may be grasped by a user to help remove a payment card secured to the attachment flap 24. The extension flap 21, attachment flap 24, and removal tab 25 are cutout from the third section 13, except along the respective fold lines 26 and 27. Thus, extension flap 21, attachment flap 24, and removal tab 25 may be coplanar with the remaining portions of the third section 13, or displaced away from the third section along fold lines 26 and 27. The second section is not visible in this figure as it is hidden behind the third section 13, but is secured to the first section 11 along fold line 15.

Figure 5:
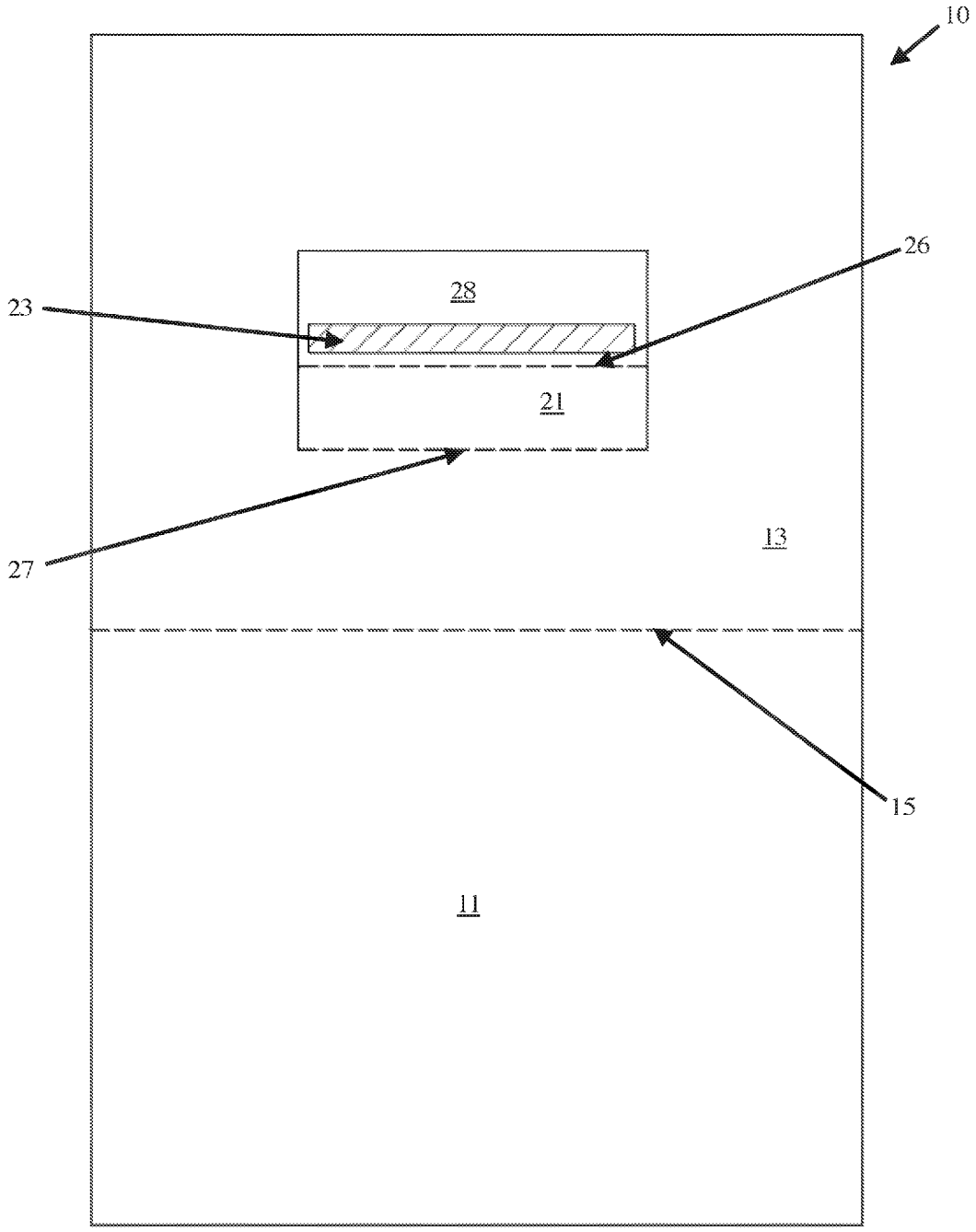
FIG. 5 is a front view of another payment card enclosure according to selected embodiments of the current disclosure.

FIG. 5 is a front view of another payment card enclosure according to selected embodiments of the current disclosure. Similar to FIG. 4, the payment card enclosure 10 includes an extension flap 21 secured to the third section 13 along fold line 27. The extension flap 21 is secured to the attachment flap 28 along fold line 26. A strip of adhesive 23 is affixed to the attachment flap 28 to secure a payment card (not shown in this figure) thereto. The extension flap 21 and attachment flap 28 are cutout from the third section 13, except along the respective fold lines 26 and 27. Thus, extension flap 21 and attachment flap 28 may be coplanar with the remaining portions of the third section 13, or displaced away from the third section along fold lines 26 and 27. The second section is not visible in this figure as it is hidden behind the third section 13, but is secured to the first section 11 along fold line 15. In this figure, the extension flap 21 is secured to the third section 13 on its opposite side, allowing it to angle towards the first section 11 instead of away.

Figure 6:
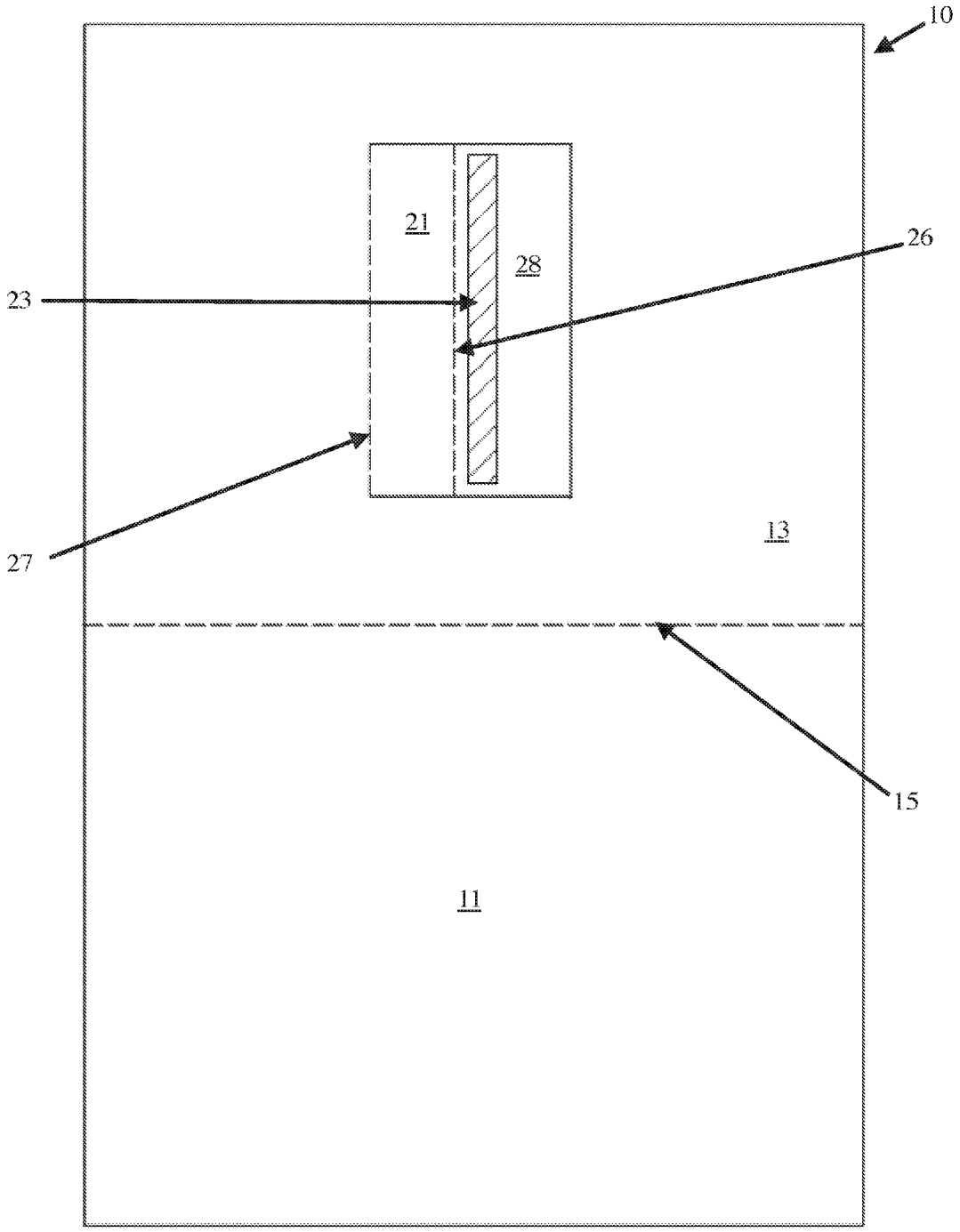
FIG. 6 is a top view of an additional payment card enclosure according to selected embodiments of the current disclosure.

FIG. 6 is a top view of an additional payment card enclosure according to selected embodiments of the current disclosure. The payment card enclosure 10 is similar to that in FIGS. 4 and 5; however, the extension flap 21 and attachment flap 28 are rotated ninety degrees, such the extension flap 21 angles towards the side of the payment card enclosure 10. The payment card enclosure 10 includes an extension flap 21 secured to the third section 13 along fold line 27. The extension flap 21 is secured to the attachment flap 28 along fold line 26. A strip of adhesive 23 is affixed to the attachment flap 28 to secure a payment card (not shown in this figure) thereto. The extension flap 21 and attachment flap 28 are cutout from the third section 13, except along the respective fold lines 26 and 27. Thus, extension flap 21 and attachment flap 28 may be coplanar with the remaining portions of the third section 13, or displaced away from the third section along fold lines 26 and 27. The second section is not visible in this figure as it is hidden behind the third section 13, but is secured to the first section 11 along fold line 15. In this figure, the extension flap 21 is secured to the third section 13 on its opposite side, allowing it to angle towards the first section 11 instead of away.

Figure 7:
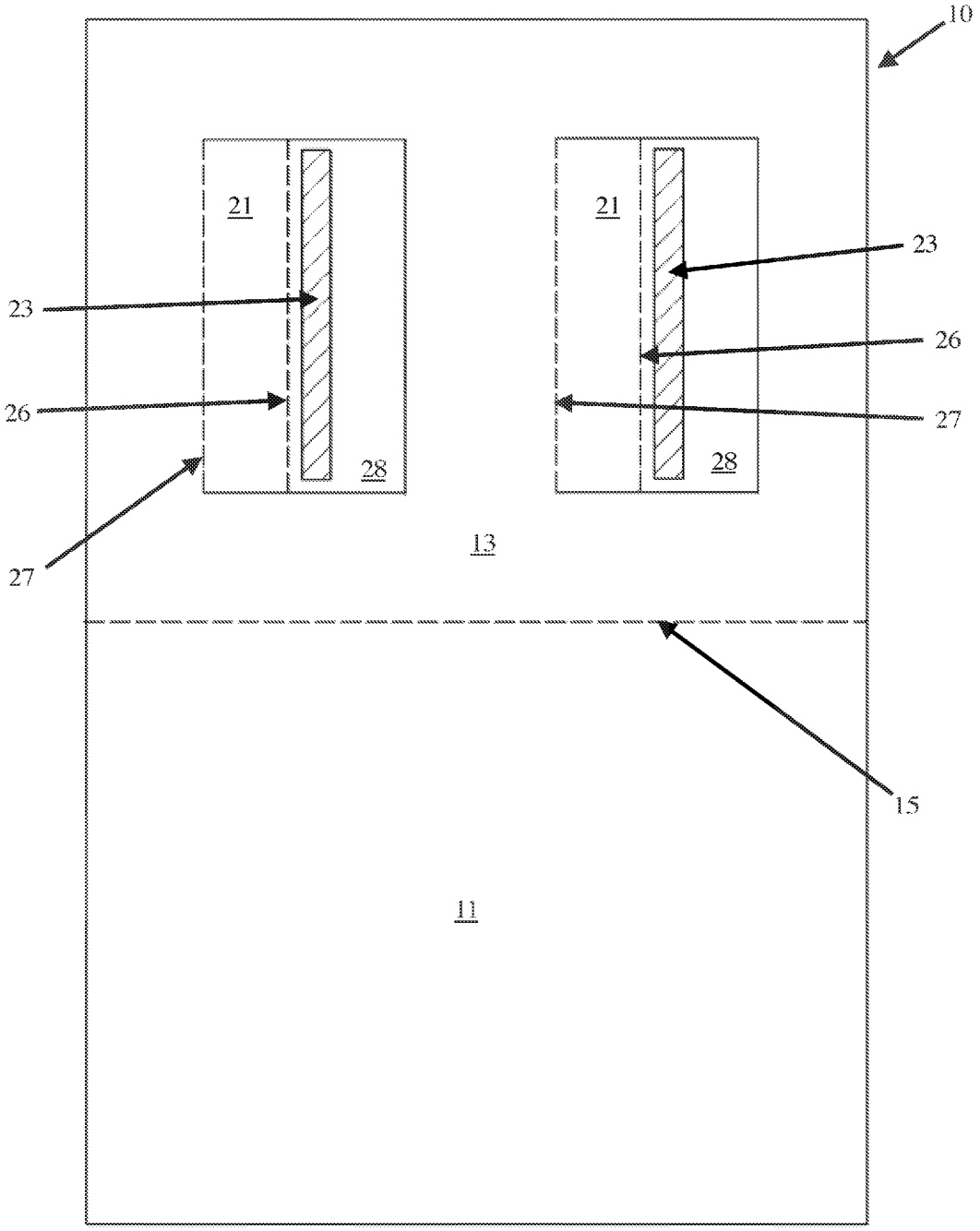
FIG. 7 is top view of a multiple payment card enclosure according to selected embodiments of the current disclosure.

FIG. 7 is top view of a multiple payment card enclosure according to selected embodiments of the current disclosure. Multiple attachment flaps 28 are provided to secure multiple payment cards to the payment card enclosure 10. Each attachment flap 28 includes an adhesive 23 applied thereto, which is used to secure a payment card to the attachment flap 28. During storage and transport, a strip of material (not shown in this figure) may be placed over the adhesive 23 to prevent other objects from adhering to attachment flap 28. Right before use, this strip of material may be removed providing access to the adhesive. As with other embodiments, each attachment flap 28 is secured to an extension flap 21 along a fold line 26. Each extension flap 21, in turn, is secured to the third section 13 along a fold line 27. The second section is not visible in this figure as it is hidden behind the third section 13, but is secured to the first section 11 along fold line 15.

To make a payment card enclosure according to selected embodiments of the current disclosure, a sheet of material is cut into a rectangle, and divided into three equal sections. Fold lines may be used to delineate each section. In one of the three sections that is not the innermost section, cuts are made to form a flap section that has one side still affixed, that is not cut, to the section such that the flap may bend, but may not be removed from, the section from which it was cut. The portion of material between the flap and the section may include a fold line. The flap is separated into two portions—an extension flap and an attachment flap. The attachment flap is secured on only one side to the extension flap. The extension flap is secured on two sides: on one side to the attachment flap and on the other side to the section from which it was cut. An adhesive, discussed in more detail below is applied to the attachment flap. The section that includes the flap is then folded over the middle section. An adhesive is applied, in certain embodiments before the sections are folded together, that permanently secures the two sections together. The two sections should be folded such that surface of the attachment flap with the adhesive is not facing the middle section, but is facing outward.

The adhesive affixed to the attachment flap should be selected to provide appropriate adhesion to removably secure a payment card to the attachment flap. Two-sided tape, fugitive glue, credit card glue, booger glue, snot glue, and other pressure sensitive adhesives may be used to secure the payment card to the attachment flap. These adhesives include pressure sensitive adhesives that are based on an elastomer compounded with a suitable tackifier (e.g. rosin ester) to provide a strong enough bond to secure the payment card to the attachment flap, but a weak enough bond to allow a user to separate the payment card from the attachment flap without requiring excessive force or causing damage to the payment card. A strip of material is placed over the adhesive such that the adhesive does not adhere to objects until the user is ready to affix the payment card to the payment card enclosure.

The adhesive used to secure the outer section to the middle section should be a stronger, permanent adhesive. While a pressure sensitive adhesive may be used, it should be stronger such that the two sections cannot be separated, or at least cannot be separated without damaging the sections.

To enclose a payment card, the user takes the payment card enclosure and removes the strip covering the adhesive affixed to the attachment flap. A payment card is then positioned on the attachment flap and pressure is applied forcing the payment card towards the attachment flap. The payment card and attachment flap is then displaced away from the surrounding section, causing the flaps to fold along the fold lines. This results in a three-dimensional effect of the payment card being raised away from the surrounding surface of the section of the payment card enclosure. A message may be inscribed on the remaining portion of the payment card enclosure, on either outermost section. The payment card enclosure may then be folded along a fold line that resides between the middle section and the outermost section without the flap portion. This results in a payment card enclosure that is the size of one of the sections in has an approximate maximum thickness of each of the three sections plus the thickness of the payment card. The folded payment card enclosure is then placed into an envelope for delivery to its intended recipient. The envelope may have an aesthetically pleasing pattern or design on its external surface, such as one that appears similar to gift-wrap used for larger packages. The payment card enclosure itself may also have patterns, designs, artwork, messages, quotes, stories, sayings, and other artistic material printed thereon or affixed thereto.

When the recipient receives the payment card enclosure, the recipient unfolds the two outermost sections away from each other, revealing the payment card therein. As discussed below, resiliency in the material causes the attachment flap and payment card to be displaced away from the surrounding section.

Particular embodiments of the current disclosure provide for the payment card enclosure to be made from paper or card stock. Such a material is easily cut and folded, and may be made stiff enough to support to the payment card. Other embodiments provide for a payment card enclosure made from other materials such as plastic or metal. These materials may require more extensive scoring to create appropriate fold lines, or even hinges to provide for appropriate movement along fold lines between the sections. However, some resiliency is preferred along the fold lines between the flaps and the section to which the flaps are attached. The initial displacement of the payment card from the section creates a spring like force such that when the recipient unfolds the sections, the payment card is automatically displaced from the section to provide a three-dimensional effect.

While various embodiments of the present invention have been described above, it should be understood that they have been presented by way of example only, and not of limitation. Likewise, the various diagrams may depict an example architectural or other configuration for the invention, which is provided to aid in understanding the features and functionality that can be included in the invention. The invention is not restricted to the illustrated example architectures or configurations, but the desired features can be implemented using a variety of alternative architectures and configurations.

Indeed, it will be apparent to one of skill in the art how alternative functional configurations can be implemented to implement the desired features of the present invention. Additionally, with regard to flow diagrams, operational descriptions and method claims, the order in which the steps are presented herein shall not mandate that various embodiments be implemented to perform the recited functionality in the same order unless the context dictates otherwise.

Although the invention is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the invention, whether or not such embodiments are described and whether or not such features are presented as being a part of a described embodiment. Thus, the breadth and scope of the present invention should not be limited by any of the above-described exemplary embodiments.

That which is claimed:

1. A payment card enclosure comprising a first section, a second section, and a third section, where the first section is secured to the second section, and where the second section is secured to the third section, where the third section comprises an extension flap and an attachment flap, where the extension flap and the attachment flap are cut from the third section, where the extension flap is secured to the third section along a fold line, where the attachment flap is secured to the extension flap, and where the attachment flap comprises an adhesive.

2. The payment card enclosure of claim 1, wherein the first section is secured to the second section along a fold line, and wherein the second section is secured to the third section along a fold line.

3. The payment card enclosure of claim 1, further comprising an adhesive, where the adhesive is between the second section and third section, where the adhesive affixes the second section to the third section.

4. The payment card enclosure of claim 3, wherein there is no adhesive in between a middle portion of the second section and a middle portion of the third section.

5. The payment card enclosure of claim 1, wherein the attachment flap comprises a removal tab.

6. The payment card enclosure of claim 1, further comprising a payment card, where the payment card is secured to the attachment flap by the adhesive.

7. The payment card enclosure of claim 1, wherein the extension flap is angled toward the first section.

8. The payment card enclosure of claim 1, wherein the extension flap is angled towards a side of the third section that is not secured to the second section.

9. The payment card enclosure of claim 1, wherein the third section further comprises a second extension flap and a second attachment flap, where the second extension flap and second attachment flap are cut from the third section, where the second extension flap is secured to the third section along a fold line, and where the second attachment flap is secured to the second extension flap.

10. A payment card enclosure comprising a first section, a second section, a third section, and a permanent adhesive, where the first section is secured to the second section along a fold line, and where the second section is secured to the third section along a fold line, where the permanent adhesive is between the second section and third section, where the permanent adhesive permanently affixes the second section to the third section, where the third section comprises an extension flap and an attachment flap, where the extension flap and attachment flap are cut from the third section, where the extension flap is secured to the third section along a fold line, and where the attachment flap is secured to the extension flap, where the attachment flap comprises an adhesive.

11. The payment card enclosure of claim 10, wherein there is no permanent adhesive in between a middle portion of the second section and a middle portion of the third section.

12. The payment card enclosure of claim 10, wherein the extension flap is angled toward the first section.

13. The payment card enclosure of claim 10, wherein the extension flap is angled towards a side of the third section that is not secured to the second section.

14. The payment card enclosure of claim 10, wherein the third section further comprises a second extension flap and a second attachment flap, where the second extension flap and second attachment flap are cut from the third section, where the second extension flap is secured to the third section along a fold line, and where the second attachment flap is secured to the second extension flap.

* * * * *